US005252943A

United States Patent [19]

Kitabayashi et al.

[11] Patent Number: 5,252,943

[45] Date of Patent: Oct. 12, 1993

[54] RESISTOR ELEMENT WHOSE ELECTRICALLY RESISTIVE LAYER HAS EXTENSION INTO OPENINGS IN CYLINDRICAL CERAMIC SUPPORT

[75] Inventors: Motoi Kitabayashi, Nagano; Soya Miyajima, Ina; Yasuhito Yajima; Takayuki Ogasawara, both of Nagoya, all of Japan

[73] Assignees: NGK Insulators, Ltd.; KOA Corporation, both of Japan

[21] Appl. No.: 756,877

[22] Filed: Sep. 9, 1991

[30] Foreign Application Priority Data

Sep. 13, 1990 [JP] Japan ..... 2-245676

[51] Int. Cl.[5] ..... H01C 1/02

[52] U.S. Cl. ..... 338/273; 338/302; 338/258; 338/280

[58] Field of Search ..... 338/273, 272, 280, 281, 338/302, 21, 258

[56] References Cited

U.S. PATENT DOCUMENTS 2,658,980 11/1953 Weides et al. ..... 338/262
4,513,615 4/1985 Sato et al. .
4,903,001 2/1990 Kikuchi .
4,920,635 5/1990 Yajima .
5,061,350 10/1991 Ishiguro et al. .

FOREIGN PATENT DOCUMENTS 585795 11/1951 Fed. Rep. of Germany .
6753328 4/1968 Fed. Rep. of Germany .
7919547 1/1984 Fed. Rep. of Germany .
3935936 5/1990 Fed. Rep. of Germany .

*Primary Examiner*—Marvin M. Lateef
*Attorney, Agent, or Firm*—Parkhurst, Wendel & Rossi

[57] ABSTRACT

A resistor element including a cylindrical ceramic support having two openings open on longitudinally opposite end faces thereof, an electrically resistive layer formed on an outer circumferential surface, a pair of electrical conductors for connecting the electrically resistive layer to an external circuit, each of which has an end portion inserted into a corresponding one of the openings of the ceramic support, and an electrically conductive adhesive filling each opening of the ceramic support, for securing the end portion of the corresponding conductor to the ceramic support. The electrically resistive layer has two integrally formed extensions for covering the opposite end faces of the ceramic support, respectively, and respective inner wall surfaces of the openings of the ceramic support. The conductors are electrically connected to the extensions of the resistive layer by the electrically conductive adhesive filling each opening of the ceramic support.

9 Claims, 4 Drawing Sheets

RESISTOR ELEMENT WHOSE ELECTRICALLY RESISTIVE LAYER HAS EXTENSION INTO OPENINGS IN CYLINDRICAL CERAMIC SUPPORT

BACKGROUND OF THE INVENTION

1. Field of the Invention

The present invention relates in general to a resistor element having an electrically resistive thin film, and more particularly to such a resistor element which is suitably used for a temperature sensor or a thermal flow meter, for example.

2. Discussion of the Prior Art

An example of a known resistor element of the above type is shown in FIG. 1. The resistor element includes a ceramic tube 2 formed of alumina, for example, and a thin metallic film 4 which is made of platinum or other metal, and which is formed on the outer circumferential surface of the tube 2. The metallic film 4 is suitably patterned so as to have a desired resistance value. The patterned metallic film 4 is electrically connected at the longitudinally opposite ends of the ceramic tube 2, to a pair of lead wires 6, 6 made of platinum, for example, by respective electrically conductive connectors 8. The connectors 8 are obtained by mixing an electrically conductive material, such as platinum, with glass, for example.

In the known resistor element of the above type, the electrically conductive connectors 8 for connecting the lead wires 6 to the metallic film 4 are also used for securing the lead wires 6 to the ceramic tube 2. However, the use of the connectors 8 undesirably pushes up the cost of fabricating the resistor element, since the connectors 8 contain a relatively large amount of a rather expensive electrically conductive material, such as platinum.

In view of the above drawback, a method as illustrated in FIG. 2 is proposed for fabricating the resistor element. According to the method, an end portion of each lead wire 6 is inserted a suitable distance into the corresponding end portion of an central bore of the ceramic tube 2, and is bonded to the inner circumferential surface of the tube 2 by a suitable adhesive 10, such as glass. Then, an electrically conductive paste for the connector 8 is applied to the corresponding end face of the ceramic tube 2, so that the lead wire 6 is electrically connected by the connector 8 to the metallic film 4 formed on the outer circumferential surface of the ceramic tube 2.

In the resistor element of the type shown in FIG. 2, however, the metallic film 4 has to be electrically connected to the lead wires 6 by the electrically conductive connectors 8, after the lead wires 6 are secured by bonding to the ceramic tube 2 by the adhesive 10. Thus, the above-described method requires an increased number of fabricating steps to obtain the intended resistor element, and eventually pushes up the cost of the element. Further, if external forces act on the lead wires 6 while the electrically conductive paste is applied, dried and then heat-treated to form the connector 8 in the process of fabricating the resistor element, or while the lead wires 6 are handled during practical use of the element, the connector 8 is subjected to stress, and suffers from cracks caused by the stress. Thus, the known resistor element constructed as described above has relatively low operating reliability and undesirably reduced durability.

SUMMARY OF THE INVENTION

The present invention was developed in the light of the above prior art situations. It is therefore an object of the invention to provide a resistor element which can be fabricated in a simple process, and whose electrical connections using a conductive adhesive are advantageously protected against cracks during practical use of the element.

The above object may be attained according to the principle of the present invention, which provides a resistor element for determining a parameter, comprising: (a) a cylindrical ceramic support having two openings open on longitudinally opposite end faces thereof, respectively; (b) an electrically resistive layer which is formed on an outer circumferential surface of the ceramic support, the electrically resistive- layer having two integrally formed extensions which at least partially cover the opposite end faces of the ceramic support, respectively, and respective inner wall surfaces of the two openings of the ceramic support; (c) a pair of electrical conductors for connecting the electrically resistive layer to an external circuit, each of the electrical conductors having an end portion which is inserted into a corresponding one of the openings of the ceramic support; and (d) an electrically conductive adhesive filling each of the two openings of the ceramic support, for securing the end portion of a corresponding one of the electrical conductors to the ceramic support, the electrically conductive adhesive electrically connecting each of the electrical conductors to a corresponding one of the two extensions of the electrically resistive layer.

In the resistor element of the present invention constructed as described above, the electrically resistive layer is integrally and continuously formed on the opposite end faces of the ceramic support and the inner wall surfaces of the longitudinally opposite openings of the support, as well as on the outer circumferential surface of the support. Therefore, the electrically conductive adhesive filling the openings of the ceramic support serves not only to secure the electrical conductors to the ceramic support, but also to electrically connect the conductors to the electrically resistive layer at its extensions within the openings of the ceramic support. Accordingly, there is no need to apply the electrically conductive adhesive to the outer surface of the ceramic support, nor is it necessary to use an adhesive adapted exclusively for securing the lead wires to the ceramic support before forming an electrically conductive connector on each of the opposite end faces of the ceramic support. Thus, the present resistor element requires a reduced number of fabricating steps, and is available at an accordingly reduced cost. Further, even if external forces act on the electrical conductors in the process of fabricating the resistor element or upon handling of the element in practical use, the electrically conductive adhesive is effectively protected against cracks, resulting in significantly improved durability of the resistor element.

In one form of the invention, the ceramic support has a central bore formed through a radially inner portion thereof, which central bore includes the above-indicated two openings.

In another form of the invention, the ceramic support has two recesses as the above-indicated two openings, which recesses are formed in longitudinally opposite end portions of the ceramic support.

BRIEF DESCRIPTION OF THE DRAWINGS

The foregoing and other objects, features and advantages of the present invention will be better understood by reading the following detailed description of presently preferred embodiments of the invention, when considered in connection with the accompanying drawings, in which:

FIG. 3(*b*) is a cross sectional view showing the resistor element of FIG. 3(*a*) before lead wires are secured to a ceramic support;

FIG. 4(*b*) is a cross sectional view showing the resistor element of FIG. 4(*a*) before lead wires are secured to a ceramic support.

DETAILED DESCRIPTION OF THE PREFERRED EMBODIMENTS

Figure 1:
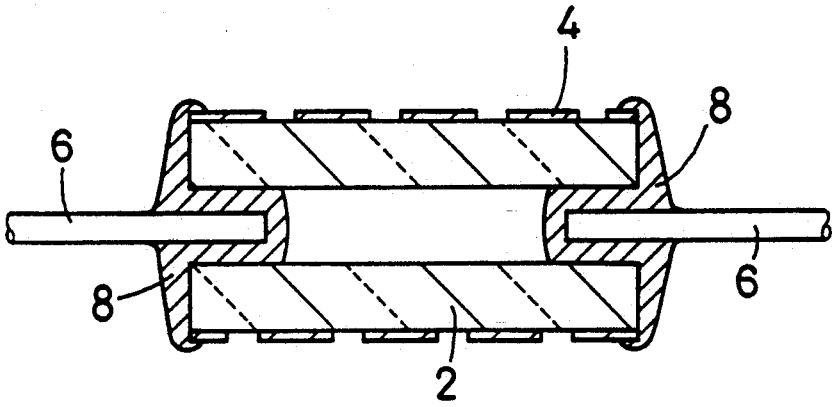
FIG. 1 is an elevational view in longitudinal cross section of a known resistor element having an electrically resistive thin film.
Figure 2:
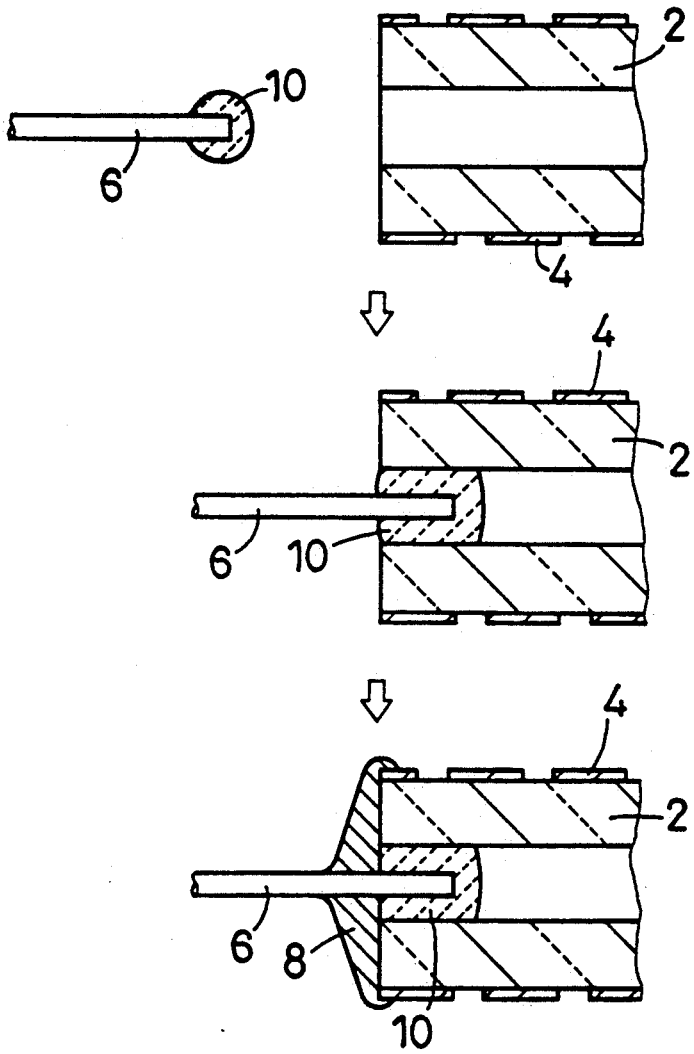
FIG. 2 is explanatory cross sectional views of another known resistor element, illustrating a process for connecting a lead wire to a ceramic tube.
Figure 3A:
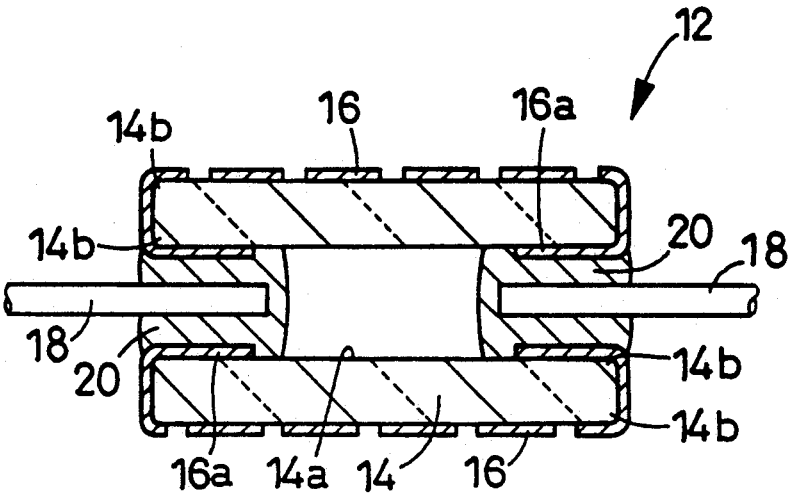
FIG. 3(*a*) is an elevational view in longitudinal cross section of one embodiment of a resistor element of the present invention.
Figure 3B:
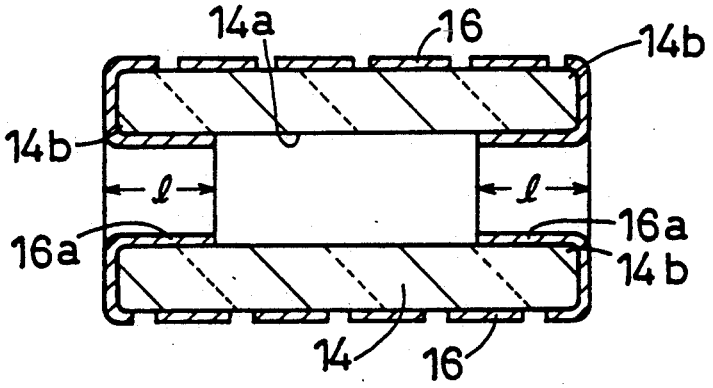

Referring first to FIG. 3(*a*), there is illustrated a thin-film type resistor element 12 as one preferred embodiment of the present invention. The resistor element 12 has a cylindrical ceramic support in the form of a tubular ceramic support 14 formed of a known ceramic material such as alumina, and a pair of electrical conductors or lead wires 18, 18 secured to the ceramic support 14. More specifically, the lead wires 18 are inserted suitable distances at their end portions in respective end portions of a central bore 14*a* formed through a radially central portion of the ceramic support 14. In this condition, the lead wires 8 are secured to the inner wall surface of the central bore 14*a* of the support 14, by respective masses of an electrically conductive adhesive 20.

On the outer circumferential surface of the tubular ceramic support 14, there is formed an electrically resistive layer 16 formed of a suitable metal, such as platinum. As well known in the art, an electrically resistive metallic film is formed on the outer surface of the ceramic support 14, by a known physical or chemical method such as sputtering, plating, chemical vapor deposition (CVD) or vacuum evaporation, and then trimmed by a laser or other means in a spiral pattern, to provide the electrically resistive layer 16. The resistive layer 16 formed on the ceramic support 14 has two integrally formed extensions 16*a* which cover the respective longitudinally opposite end faces of the ceramic support 14, and the respective end portions of the inner wall surface of the central bore 14*a* of the ceramic support 14. Each of the extensions 16*a* has a predetermined length (l) in the longitudinal direction of the support, as shown in FIG. 3(*b*). The formation of the resistive layer 16 may be effected in various manners other than those described above. For example, a suitable metallic powder is dispersed in an organic vehicle to obtain a slurry, which is then applied to the outer surface of the ceramic support 14 and heat-treated, so that an electrically resistive metallic film is formed on the support 14. In this case, too, the resistive film is trimmed by a laser, for example, in a suitable pattern, to form the electrically resistive layer 16.

In the resistor element 12 having the electrically resistive layer 16 as described above, the length (l) of each extension 16*a* formed on the inner wall surface of the central bore 14*a* of the ceramic support 14 is suitably determined, depending on dimensions of the ceramic support 14 and the central bore 14*a*, for example. Nevertheless, the length (l) of the extension 16*a* is preferably at least 0.3 mm, taking into account an area of contact of the extension 16*a* with the electrically conductive adhesive 20 for connecting the extension 16*a* to the corresponding lead wire 18. The length (l) of the extensions 16*a* may be controlled when the electrically resistive layer 16 is formed on the outer surface of the ceramic support 14. In the case where the resistive layer 16 is formed by sputtering, for example, the length (l) of the extensions 16*a* can be easily regulated by controlling a pressure of argon (Ar) gas, which is one of the controllable sputtering conditions. Namely, the length (l) of the extensions 16*a* increases with an increase in the Ar pressure, while the length (l) of the extensions 16*a* decreases with a decrease in the Ar pressure.

The inventors of the present invention made some specimens of the instant resistor element by using a tubular ceramic support (14) having an outer diameter of 0.5 mm, an inner diameter (a diameter of a central bore 14*a*) of 0.3 mm, and a length of 2 mm. On the outer surface of the ceramic support (14) of each specimen, a platinum thin layer (16) is formed by sputtering under a specific Ar pressure as indicated below. As a result, the platinum thin layer (16) of each specimen was formed with two integral opposite extensions (16*a*) each having a specific length (l) as indicated below, which extensions (16*a*) were formed so as to cover the inner wall surface of the central bore (14*a*) of the ceramic support (14).

| Ar Pressure | Length (l) of Extension of Platinum thin layer |
|---|---|
| 0.003 Torr | 0.41 mm |
| 0.03 Torr | 0.45 mm |
| 0.1 Torr | 0.53 mm |

Generally, the tubular ceramic support 14 used as the ceramic support has right-angle edges formed at the boundaries between the longitudinally opposite end faces and the outer and inner circumferential surfaces. During firing of the resistor element, therefore, the portions of the resistive layer 16 formed at the end portions of the outer and inner circumferential surfaces and the opposite end faces of the support 14 may be subjected to tensile forces which act in the directions away from the right-angle edges of the support 14. As a result, the electrically resistive layer 16 may be torn at the right-angle edges of the ceramic support 14 during firing of the resistor element. In the present embodiment, the right-angle edges of the ceramic support 14 are rounded or chamfered at the boundaries between the opposite end faces and the outer and inner circumferential surfaces of the support 14, to thereby provide rounded or chamfered portions 14*b*. Namely, the ceramic support 14 includes longitudinally opposite, radially outer rounded portions 14*b* which bound the outer circumferential surface and the opposite end faces of the support 14, and longitudinally opposite, radially inner rounded portions 14*b* which bound the opposite end faces of the support and the inner wall surface of the central bore 14*a* of the support 14. Each rounded portion 14*b* has a suitable radius of curvature. These rounded portions 14*b* effectively prevent the electrically resistive layer 16 from being torn at the boundaries between the opposite end faces and the inner and outer circumferential surfaces of the support 14 during firing of the resistor element as described later.

The above-indicated radius of curvature of each rounded portion 14*b* of the ceramic support 14 is preferably at least 5 μm, more preferably at least 10 μm. The inventors of the present invention conducted an experiment using a ceramic support (14) whose rounded portions (14*b*) have a radius of curvature of 8 μm. When an electrically resistive platinum layer (16) having a thickness of 4000A was formed by sputtering on the surface of ceramic support (14), and then heat-treated at 900° C. for 30 minutes, it was confirmed that the platinum layer (16) was free from tearing or cutting at the rounded portions (14*a*) of the ceramic support (14).

The lead wires 18 made of a metallic material, such as stainless steel or platinum, are secured to the longitudinally opposite end portions of the ceramic support 14 which bears the electrically resistive layer 16 thereon. Namely, the lead wires 18 are inserted suitable distances at their end portions into the respective end portions of the central bore 14*a* of the ceramic support 14. In this condition, the end portions of the lead wires 18 which are inserted into the central bore 14*a* are bonded to the inner surface of the ceramic support 14 by the respective masses of the electrically conductive adhesive 20, which fill the open end portions of the bore 14*a*. Then, the resistor element is heat-treated by a suitable known method, whereby the lead wires 18 are firmly secured to the ceramic support 14.

In the manner as described above, the lead wires 18 are electrically connected to the extensions 16*a* of the electrically resistive layer 16 which are formed so as to cover the end portions of the inner wall surface of the central bore 14*a* of the ceramic support 14, by the electrically conductive adhesive masses 20. The adhesive 20 may be selected from any known electrically conductive adhesives capable of bonding the electrically resistive layer 16 and the lead wires 18 both of which are made of metal. Preferably, the adhesive 20 is prepared from a mixture of platinum and glass. The instant resistor element 12 may further have a protective coating layer (not shown as used in the conventional resistor elements, for covering the outer surface of the ceramic support 14, to thereby cover an exposed portion of the layer 16. The protective coating layer is formed of glass, for example, with a suitable thickness.

The resistor element 12 constructed as described above is connected to an external circuit by the lead wires 18 in the manner known in the art, and is favorably used for a temperature sensor or other devices.

In the resistor element 12 constructed according to the present invention, the lead wires 18 are secured to the inner surface of the ceramic support 14 by the electrically conductive adhesive masses 20 which exist only within the opposite open ends of the central bore 14*a* of the support 14. Therefore, the amount of the adhesive used for connecting the electrically resistive layer 16 and the lead wires 18 can be favorably reduced. Further, the present resistor element 12 requires a reduced number of fabricating steps, and is available at an accordingly reduced cost. Moreover, even if external forces act on the lead wires 18 in the process of fabricating the resistor element or upon handling of the element in practical use, the electrically conductive adhesive 20 for bonding the lead wires 18 to the ceramic support 14 is effectively protected against cracks or deformation, since the adhesive masses 20 are respectively secured to and surrounded by the inner wall surfaces of the opposite end portions of the central bore 14*a*, and thus reinforced by the corresponding end portions of the ceramic support 14.

Figure 4A:
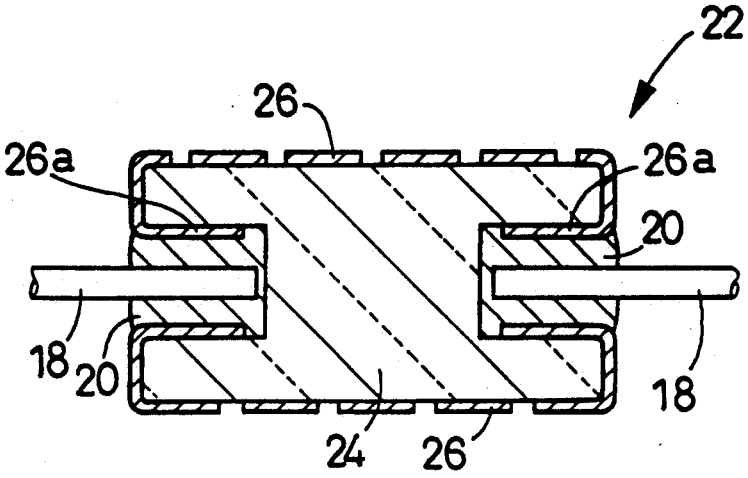
FIG. 4(*a*) is an elevational view in longitudinal cross section of another embodiment of the resistor element of the present invention.
Figure 4B:
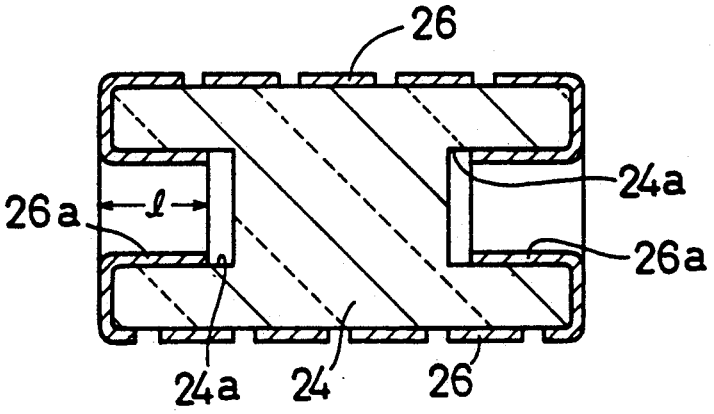

Referring next to FIGS. 4(*a*) and 4(*b*), there is illustrated another embodiment of a resistor element 22 of the present invention. The resistor element 22 has a cylindrical ceramic support in the form of a rod-like ceramic support 24 which is solid and has a circular cross sectional shape. The ceramic support 24 has two openings in the form of recesses 24*a*, 24*a* having a suitable depth, which are formed in longitudinally opposite end portions of the support 24. An electrically resistive metallic layer 26 is formed in a suitable pattern on the outer surface of the ceramic support 24. As in the preceding embodiment, the resistive layer 26 has two integrally formed extensions 26*a*, 26*a* each having a suitable length (l), which are formed on the respective end faces of the support 24 and the respective inner wall surfaces of the recesses 24*a*, 24*a*.

As in the preceding embodiment, the electrical conductors or lead wires 18, 18 are inserted suitable distances at their end portions into the respective recesses 24*a*, 24*a* formed in the opposite end portions of the ceramic support 24. In this state, the lead wires 18 are secured to the inner surface of the ceramic support 24 by the respective electrically conductive adhesive masses 20 which fill the corresponding recesses 24*a*. Thus, the lead wires 18 are electrically connected to the extensions 26*a* of the electrically resistive layer 26, which are formed on the inner wall surfaces of the recesses 24*a*.

While the present invention has been described in its presently preferred embodiments, for illustrative purpose only, it is to be understood that the present invention is by no means limited to the illustrated embodiments, but may be embodied with various changes, modifications and improvements which may occur to those skilled in the art, without departing from the spirit and scope of the invention.

What is claimed is:

1. A resistor element for determining a parameter, comprising:

a cylindrical ceramic support having a central bore formed therethrough with two opposite openings which are open on longitudinally opposite end faces of the ceramic support, respectively;

and electrically resistive layer consisting essentially of a platinum thin-film formed on said ceramic support, said electrically resistive layer being formed principally on an outer circumferential surface of said ceramic support, and formed integrally with two extensions which respectively cover said opposite end faces of said ceramic support, and corresponding end portions of an inner wall of said central bore;

a pair of electrical conductors for connecting said electrically resistive layer to an external circuit, each of said electrical conductors having an end portion which is inserted into a corresponding one of said opposite openings of said ceramic support; and an electrically conductive adhesive filling each of said opposite openings of said ceramic support, for securing said end portion of a corresponding one of said electrical conductors to said ceramic support, said electrically conductive adhesive electrically connecting each of said electrical conductors to a corresponding one of said two extensions of said electrically resistive layer.

2. A resistor element according to claim 1, wherein each of said two extensions has a length of at least 0.3 mm in a longitudinal direction of said ceramic support.

3. A resistor element according to claim 1, wherein said ceramic support includes first rounded portions which bound said outer circumferential surface and said opposite end faces of said ceramic support, and second rounded portions which bound said opposite end faces and said inner wall surfaces of said openings of said ceramic support, said first and second rounded portions being covered by said two extensions of said electrically resistive layer.

4. A resistor element according to claim 3, wherein each of said first and second rounded portions of the ceramic support has a radius of curvature of at least 5 μm.

5. A resistor element according to claim 4, wherein each of said first and second rounded portions of the ceramic support has a radius of curvature of at least 10 μm.

6. A resistor element according to claim 1, further comprising a protective coating layer formed of glass, for covering an exposed portion of said electrically resistive layer.

7. A resistor element according to claim 1, wherein said ceramic support is formed of alumina.

8. A resistor element according to claim 1, wherein said electrically conductive adhesive is formed from a mixture of platinum and glass.

9. A resistor element for determining a parameter, comprising:

a cylindrical ceramic support having a central bore formed therethrough with two opposite openings which are open on longitudinally opposite end faces of the ceramic support;

an electrically resistive layer consisting essentially of a platinum thin-film formed on said ceramic support, said electrically resistive layer being formed principally on an outer circumferential surface of said ceramic support, and formed integrally with two extensions which respectively cover said opposite end faces of said ceramic support, and corresponding end portions of an inner wall of said central bore;

said ceramic support including first rounded edges which bound said outer circumferential surface and said opposite end faces of said ceramic support, and second rounded edges which bound said opposite end faces and said inner wall of said central bore of said ceramic support, said first and second rounded edges being formed over the entire circumference of said ceramic support at radially outer and inner portions thereof, respectively, said first and second rounded edges being covered by said two extensions of said electrically resistive layer;

a pair of electrical conductors for connecting said electrically resistive layer to an external circuit, each of said electrical conductors having an end portion which is inserted into a corresponding one of said opposite openings of said ceramic support; and an electrically conductive adhesive filling said opposite openings of said ceramic support, for securing said end portions of said electrical conductors to said ceramic support, said electrically conductive adhesive electrically connecting said electrical conductors to said two extensions of said electrically resistive layer.

* * * * *